United States Patent [19]

Grasshoff et al.

[11] Patent Number: 4,737,299

[45] Date of Patent: Apr. 12, 1988

[54] LUBRICATING GREASES FOR HIGH OPERATING TEMPERATURES

[75] Inventors: Hans D. Grasshoff, Hamburg; Herbert Maak, Seevetal, both of Fed. Rep. of Germany

[73] Assignee: Texaco Technologie Europa GmbH, Hamburg, Fed. Rep. of Germany

[21] Appl. No.: 914,707

[22] Filed: Oct. 2, 1986

[30] Foreign Application Priority Data

Oct. 5, 1985 [DE] Fed. Rep. of Germany ..... 3535713

[51] Int. Cl.[4] ..... C16M 117/00

[52] U.S. Cl. ..... 252/18; 252/25; 252/41; 252/421

[58] Field of Search ..... 252/25, 41, 18, 42.1

[56] References Cited

U.S. PATENT DOCUMENTS

| | | | |
|---|---|---|---|
| 3,988,248 | 10/1976 | Grasshoff | 252/25 |
| 4,100,080 | 7/1978 | Adams | 252/25 |
| 4,155,858 | 5/1979 | Adams | 252/25 |
| 4,156,655 | 5/1979 | Clarke et al. | 252/25 |
| 4,376,060 | 3/1983 | Stadler | 252/25 |
| 4,435,296 | 3/1984 | Brecks et al. | 252/25 |
| 4,435,299 | 3/1984 | Carley et al. | 252/25 |

*Primary Examiner*—William R. Dixon, Jr.
*Assistant Examiner*—Cynthia A. Prezlock
*Attorney, Agent, or Firm*—Robert A. Kulason; James J. O'Loughlin; Vincent A. Mallare

[57] ABSTRACT

Lubricating greases suitable for use at high operating temperatures which contain a complex thickening system consisting of a lithium soap of a hydroxy fatty acid, an alkali salt of boric acid and a dilithium salt of a branched alkyl chain dicarboxylic acid.

9 Claims, No Drawings

LUBRICATING GREASES FOR HIGH OPERATING TEMPERATURES

BACKGROUND OF THE INVENTION

This invention relates to lubricating greases. More particularly, this invention is directed to lubricating greases useful at high operating temperatures.

In may applications lubricating greases are superior to lubricating oils due to the plastic nature of the greases. They offer the advantage of simplifying machine constructions because the sealing of the roller bearings, which is necessary when lubricating toils are employed, can be omitted. The greases themselves protect roller bearings from dirt and water by the formation of a cushion. Today, high-grade greases frequently have the same life as the roller bearings, which means that post-lubrication is unnecessary provided the maximum operating temperature of the grease is not exceeded.

Of the various types of greases, aluminium, calcium, sodium and lithium soap greases have become particularly known. Lithium soap greases have been widely used for many years. Their extensive use is due to the fact that they combine significant advantages of calcium and sodium soap greases, i.e., they have good resistance to water, and with dropping points of about 200° C., may be used at operating temperatures of from 120° C. to 150° C.

However, due to a technical advance, it is often necessary today to control temperatures which, at least temporarily, are far in excess of the above-specified maximum temperature range for application of the conventional lithium soap greases.

For example, it has been found that for the lubrication of wheel bearings of some types of passenger cars the temperature stability of the known greases is no longer sufficient.

On mountain roads where frequent braking is required, bearing temperatures of 180° C. to 200° C. have been measured, especially in cars fitted with disc brakes mounted near the wheel bearings. When lithium soap greases of conventional type are used in such cases, there will be the risk that, under such strains, the greases will leak from the bearings and possibly smear the disc brakes.

A further example is the lubrication of hot-air fans. Here, too, temperatures of 150° C. to 200° C. may be reached.

In the course of technical development, lithium complex greases have been developed for some time which have superior temperature stability when compared to the conventional lithium soap grease which mostly consist of the lithium soap of 12-hydroxystearic acid as thickening agent.

However, none of these greases have proven to be satisfactory for all high operating temperatures and, in most cases, are not effective.

Thus, it is an object of the present invention to provide lubricating greases having operating temperatures in excess of the requirements of any operation in which they may be used.

DISCLOSURE STATEMENT

1. West German Patent Specifications Nos. DE 2,264,263 C 3 and DE 2,425,161 C 2 disclose greases with dropping points of up to 278° C., whereby the upper operating temperature range is clearly increased.

This is due, substantially, to the addition of a lithium salt of boric acid, e.g., dilithium tetraborate.

2. West German publication No. EP 0,096,919 A 1 discloses a high dropping point grease (260° C.) the increased temperature stability is due to the addition of lithium salts of boric acid. Further, salts of boric acid (i.e., alkali compounds, earth metal compounds, zinc compounds) are added to improve the pressure-absorbing capacity.

3. U.S. Pat. No. 4,376,060 discloses high dropping point greases which contain lithium salts of boric acid which are formed during the manufacturing process in the presence of polyols (glycerol). Moreover, according to this patent, a further hydroxy fatty acid of low molecular weight is added in addition to a hydroxy fatty acid of high molecular weight (12-hydroxystearic acid).

4. West German publication No. DE 3,029,750 A 1 discloses a lithium complex soap grease whose thickening agent comprises a fatty acid having 12 to 24 carbon atoms (stearic acid) and a dicarboxylic acid having 4 to 12 carbon atoms (sebacic acid/azelaic acid). Dropping points of up to 264° C. are obtained.

5. West German Patent Specification No. DE 2,157,207 C 2 discloses high dropping point greases obtained by preparing a lithium complex soap of hydroxy fatty acid having 12 to 24 carbon atoms, a lithium salt of a second hydroxycarboxylic acid having 3 to 14 carbon atoms, a dilithium salt of a dicarboxylic acid having 4 to 12 carbon atoms, or a monolithium salt of boric acid.

6. U.S. Pat. No. 3,985,662 discloses high dropping point lithium complex greases having dropping points up to in excess of 300° C. and containing a thickening system which comprises lithium soaps of epoxy-substituted and/or ethylenically unsaturated fatty acids, in combination with other lithium soaps, dilithium salts of straight chain dicarboxylic acids and also lithium salts of hydroxy-substituted aromatic acids.

SUMMARY OF THE INVENTION

The present invention provides lubricating greases for use at high operating temperatures. The lubricating greases contain a thickening system which comprises (a) a lithium soap of a hydroxy fatty acid having 12 to 24 carbon atoms, (b) an alkali salt of boric acid and (c) a dilithium salt of a dicarboxylic acid having a branched alkyl chain and a total of 5 to 14 carbon atoms of which 4 to 10 carbon atoms are present in the chain.

According to this invention, it has been found that the present greases are distinguished by excellent thermal stability and that their high-temperature properties are superior to those of known commercially available high-temperature greases. With dropping points of 300° C. and higher, the greases of the present invention may be employed up to temperatures of 280° C. in roller bearings provided a suitable base stock is used.

The life of the present greases at such high temperatures depends on the thickening agent, the lithium complex soap and also the base oil used and the additives, mainly the anti-oxidants.

The improved properties of the greases, according to the instant invention, are due to the fact that with the branched dicarboxylic acid a component has been found which significantly stabilizes the thickening system. This system comprising the lithium soap of a hydroxystearic acid in combination with lithium tetraborate, particularly in the temperature range between 200° C. and 300° C. The grease, according to the invention, is far more consistent in this range.

Generally, lubricating greases are formed of three principal components in the liquid phase, including the base oil, the thickening agent and the additives.

The commercially available greases normally contain naphthenic or paraffinic mineral oils as base oils, the refining grade of which may be selected between pale and highly refined, depending on the desired application of the greases.

In the present application, highly refined mineral oils are especially used, wherein refining of the lubricating distillate derived from the distillation of the crude mineral oil may be performed in accordance with three different procedures so as to remove most of the undesirable substances detrimental to the quality of the lubricating oil. These processes are the conventional sulphuric acid treatment (acid refining), the extraction with selective solvents (solvent refining) or the catalytic hydrogenation (hydrofining). Frequently, a combination of these procedures is used. To improve the low-temperature properties, the lubricants frequently are also subjected to dewaxing so a to remove high-melting paraffins. The refining processes for mineral oils are described in *Ullmanns Encyklopedie der technischen Chemie*, 4th edition, vol. 20, pp. 484 et seq.

Because of the applications in very high temperature ranges for the present greases, it is advantageous to use synthetic base oils instead of mineral oils so as to increase the grease life. Poly-alpha-olefins, alkyl benzene and carboxylic acid esters are preferred for this purpose. However, it is also possible to use polyalkylene glycols, silicones, halogenated hydrocarbons or polyphenylethers.

Suitable alkyl benzenes are derived from the known Friedel-Crafts syntheses by alkylation of benzene with alkyl chlorides or olefins (Ullmann, 4th edition, vol. 14, pp. 672 et seq.). The starting materials for the preparation of polymer oils are alpha-olefins prepared by ethylene oligomerization or by cracking of paraffins by different process (Ullmann, 4th edition, vol. 14, pp. 664 et seq.). In the next step these alpha-olefins are polymerized and hydrogenated ("*Synthetic Poly-alpha-olefin Lubricants Today and Tomorrow*", M. Campen, J. F. Kendrick, A. D. Markin, and Ullmann, 4th edition, vol. 20, pp. 505 et seq.).

The carboxylic acid esters used are single esters or complex esters as described in Ullmann, 4th edition, vol. 20, pp. 514 et seq.

Active substances are added to the greases as additives which improve, for instance, the oxidation stability and the corrosion control of the greases. Lubricity improving agents, anti-wear additives and high-pressure additives are likewise usual additives.

When the greases are used at high temperatures, antioxidants are of primary importance which dealy oxidation of a grease as far as possible. For instance, a polymeric 1,2-dihydro-2,2,4-trimethyl quinoline having the general formula

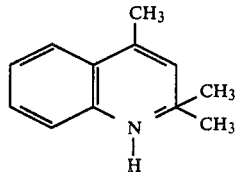

or p,p-dioctyldiphenylamine having the formula

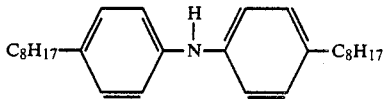

have proven satisfactory as oxidation retarding agents for the high-temperature range.

Moreover, additives for preventing bearing corrosion are added, such as calcium dinonylnaphthalene sulphonate having the formula

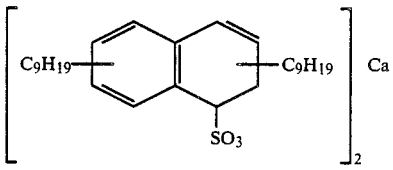

and a metal deactivator such as sodium mercaptobenzothiazole having the formula

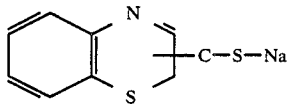

for preventing corrosion of copper and copper alloys which will be used in roller bearings (cages).

The thickening system is very important for the thermal stability of a grease. According to the present invention, a lithium complex soap is used which was prepared from a hydroxy fatty acid having 10 to 30 carbon atoms, e.g., 9-hydroxystearic acid, 10-hydroxystearic acid or 12-hydroxystearic acid. The lithium salt of 12-hydroxystearic acid is preferred. For the manufacture, a 12-hydroxystearic acid may be used which was obtained by decomposition and hydrogenation of castor oil and contains small proportions of other fatty acids. Instead of the free hydroxy fatty acid(s) one may also start from the glyceride thereof, e.g., from 12-hydroxystearin. Especially suitable is the use of esters of hydroxy fatty acids with lower alcohols such as methanol, ethanol, propanols and butanols because when these esters are used while otherwise the composition is the same, the dropping point will be higher than by use of, for example, the free hydroxy fatty acid.

As the alkali borate component of the thickening system of the greases according to the instant invention, a lithium salt of boric acid is preferred which is either prepared from boric acid or, even better, from the boricacid esters such as boric acid tributyl ester, by in situ reaction with lithium hydroxide during the process of manufacture, or which is added as lithium salt either before or during the process of manufacture. It is preferred to add dilithium tetraborate to the grease. It may be used, if applicable, as a hydrate containing water of crystallization. However, it has been found that during the development work it is also possible, instead of lithium salt of boric acid, to use a sodium salt of boric acid such as disodium tetraborate. The presence of a borate is evidently decisive for the complexation.

According to the present invention, the thickening system contains as a third component, the dilithium salt of a branched-chain dicarboxylic acid, preferably 3-tert-butyl adipic acid of the formula

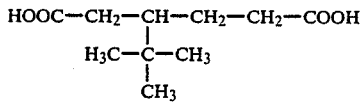

The dilithium salt of this acid surprisingly imparts a high thermal stability to the greases, according to the present invention, which cannot be achieved with an otherwise similar composition of the grease with dilithium salts of straight-chain dicarboxylic acids such as adipic acid, azelaic acid or sebacic acid. More extensive tests have shown that it is also possible, by the use of methylsuccinic acid and trimethyl adipic acid, to obtain greases whose high temperature properties are superior to those of to so-far-known lithium complex greases. Tetrapropenyl succinic acid, 2,2- or 2,4 or 3,3-dimethyl glutaric acid are as well suited as a mixture of 75 percent of 2-ethyl suberic acid, 15 percent of diethyl adipic acid and 10 percent of sebacic acid commercially available under the trade name Isosebazinsaure (see Ullman, vol. 10, pp. 138/139).

The superior properties of the greases, according to the invention, will be illustrated in the examples. To prove their advantages, especially in the high-temperature range as compared to commercially available products, not only the dropping point of these greases but also the physicodynamic properties in roller bearings were compared. The tests were chiefly made on the testing machine FE9 of the company Kugelfischer FAG. By means of this testing machine, the mean life of greases is determined under defined conditions as described by Dr. E. Kleinlein, Kugelfischer FAG: "*Testing of the Grease Life Especially at Elevated Temperatures*" and by H. D. Grabhoff/H. Maak in "*Modern Techniques in European Grease Testing*", NLGI spokesman, April 1985, pp. 20 to 27.

The test bearing mounted in the testing machine FE9 (which is intended for standardization under DIN 51 821), is filled with a predetermined quantity (2 g) of the grease to be tested. At a test temperature, produced by heating, the greased bearing is operated in the following examples at a rotational speed of 6,000 min $^{31\ 1}$ and an axially oriented testing load of 1.5 kN. Over a prolonged operating time the lubricating conditions will vary, e.g., by oxidation of the grease or by leakage of the grease due to the high temperature. This will result in an increased driving torque. A bearing failure will exist when, over a prolonged period of time, a multiple of the moment of inertia is required to drive the bearing. The strain endurance corresponds to the service life of the grease. The mean service life of the grease (mean life L 50) is determined from the statistical evaluation of at lease 5 tests under identical conditions by means of the Weibull diagram. The tests were performed in angular ball bearings type 7206 B.

All of the test charges specified in the examples were made as follows:

For a charge of 100 kg, the quantity mentioned in the examples of 12-hydroxystearic acid or of the methyl ester of 12-hydroxystearic acid respectively, together with the respective used dicarboxylic acid and one-third of the base oil calculated for the charge, are weighed into a suitable agitated vessel and heated to 85° C. At this temperature, saponification with the quantity of lithium hydroxide required for neutralization of the components takes place. When the temperature has been increased to 115° C., the alkaliborate dissolved in water is added. When a lithium salt of boric acid is formed during the process of manufacture, the boric acid is neutralized together with the fatty acids. After dehydration of the charge, the temperature is elevated to 145° C. within about one hour. At 150° C., another one-third of the base oil is added and the remaining one-third is added when the final temperature has been reached. The charge is left for another hour at this temperature for complexation and is subsequently cooled. At 100° C. additives (antioxidants, anticorrosives, antiwear additives, etc.) are added. After further cooling of the charge to 50° C., homogenizing is effected by means of the corundum disc mill. Finally, the grease is deaerated.

The following additive combinations are used in the examples as additives:

| | |
|---|---|
| 1.5 parts of p,p-dioctyldiphenylamine | antioxidant |
| 1.5 parts of alkyl diphenylamine | antioxidant |
| 0.5 parts of alkylphenyl-naphtylamine | antioxidant |
| 0.25 parts of benzotriazole | metal deactivator |

EXAMPLES 1 TO 4

| | 1 (comp.) | 2 | 3 (comp.) | 4 (comp.) |
|---|---|---|---|---|
| 12-hydrostearic acid | 12.5 | 12.5 | 12.5 | 12.5 |
| adipic acid | 5.0 | — | — | — |
| 3-tert-butyl adipic acid | — | 5.0 | — | — |
| azelaic acid | — | — | 5.0 | — |
| sebacic acid | — | — | — | 5.0 |
| dilithium tetraborate | 0.3 | 0.3 | 0.3 | 0.3 |
| lithium hydroxide monohydrate | 4.62 | 3.82 | 3.98 | 3.82 |
| additives | 3.75 | 3.75 | 3.75 | 3.75 |
| paraffinic-base refined machine oil 125 $mm^2$/sat 40° C. | 73.83 | 74.63 | 74.47 | 74.63 |
| dropping point, °C. | 223 | 300 | 252 | 257 |
| consistency class at 200° C. | 00 | 2 | 0 | 1 |
| rest penetration, mm/10 | 245 | 245 | 237 | 220 |
| worked penetration, mm/10 | 258 | 259 | 252 | 230 |
| FE 9 test, mean life | | | | |
| L50 at 150° C./h | 155 | 288 | 123 | 148 |
| L50 at 200° C./h | 18 | 27 | 12 | 18 |

It is apparent from these examples that, due to the use of the 3-tert-butyl adipic acid, properties are obtained which are not nearly obtained with the greases prepared by the use of straight-chain dicarboxylic acids.

With a dropping point of more than 300° C., with grease, according to the invention (example 2), is still inconsistency class 2 even at 200° C.

The consistency classes have been introduced by the National Lubricating Grease Institute (NLGI) in the United States and are now used throughout the world for the classification of lubricating greases in respect of their consistency. They are also standardized under DIN 51 818.

For example 2 the consistency class 2 indicates a range of 265 to 295 mm/10 by which a standardized cone penetrates into a grease under standardized conditions specified in ISO 2137. The more consistent the grease, the higher the consistency class. As will be apparent from the table, the control or comparative charges are substantially softer with values of 00, 0 and 1.

For the practical use in roller bearings, it is important to achieve minimum softening at elevated temperatures so as to prevent leakage of a lubricating grease.

From the values for the rest-penetration and the worked-penetration according to ISO 2137 it is apparent that the consistency of the greases of examples 1 to 4 is approximately equal at +25° C. which is the standard temperature.

When the greases are tested under physico-dynamic conditions, i.e., under practical conditions, the grease, according to the invention (example 2), is likewise superior to the control greases as to its life in roller bearings at 150° C. and 200° C. The FE 9 testing machine of the company Kugelfischer FAG was used to test the life of the greases. As already mentioned, the tests were performed at a rotational speed of 6,000 $min^{-1}$ and a load of 1.5 kN in angular ball bearings type 7206 B.

EXAMPLES 5 to 8

| | 5 | 6 | 7 | 8 |
|---|---|---|---|---|
| 12-hydrostearic acid | 13.0 | 13.0 | 13.0 | 13.0 |
| 3-tert-butyl adipic acid | 5.0 | 5.0 | 5.0 | 5.0 |
| boric acid | 0.5 | 0.5 | — | — |
| dilithium acid | — | — | 0.1 | 0.6 |
| lithium hydroxide | | | | |
| monohydrate | 4.23 | 4.9 | 3.8 | 3.8 |
| additives | 3.75 | 3.75 | 3.75 | 3.75 |
| paraffinic-base stock, solvent, 125 $mm^2/s$ at 40° C. | 73.52 | 72.85 | 74.35 | 73.85 |
| dropping point, °C. | 300 | 300 | 300 | 300 |
| consistency class at 200° C. | 2 | 3 | 2 | 2 |
| rest penetration, mm/10 | 214 | 160 | 204 | 253 |
| worked penetration, mm/10 | 241 | 197 | 255 | 278 |
| FE 9 test, mean life | | | | |
| L50 at 150° C./h | 218 | 202 | 235 | 265 |
| L50 at 200° C./h | 22.5 | 21 | 25 | 26 |

The examples 5 and 6 show greases in which the lithium salts of boric acid have been formed during the preparation of the greases as mentioned in the description of the process. The lithium hydroxide quantity in example 5 was calculated to monolithiumborate and in example 6 to trilithiumborate. As will be apparent from the data, both greases have an approximately equally long life. Slightly better results are achieved when dilithiumborate is added to the greases during manufacture as described (examples 7 and 8).

EXAMPLES 9 to 11

| | 9 | 10 | 11 |
|---|---|---|---|
| 12-hydrostearic acid methyl ester | 13.0 | 13.0 | 13.0 |
| 3-tert-butyl adipic acid | 4.0 | — | — |
| trimethyl adipic acid | — | 4.0 | — |
| methylsuccinic acid | — | — | 4.0 |
| lithium hydroxide | | | |
| monohydrate | 3.48 | 3.61 | 4.63 |

-continued

| | 9 | 10 | 11 |
|---|---|---|---|
| dilithium tetraborate | 0.3 | 0.3 | 0.3 |
| additives | 3.75 | 3.75 | 3.75 |
| paraffinic-base stock, stock solvate, 125 $mm^2$/sat 40° C. | 75.47 | 75.34 | 74.32 |
| dropping point, °C. | 300 | 300 | 300 |
| consistency range at 200° C. | 2 | 1 | 2 |
| rest penetration, mm/10 | 267 | 336 | 230 |
| worked penetration, mm/10 | 291 | 362 | 256 |
| FE 9 test, mean life | | | |
| L50 at 150° C./h | 222 | 201 | 213 |
| L50 at 200° C./h | 22.5 | 23 | 21.5 |

Different branched carbon chain dicarboxylic acids were used in the greases of examples 9, 10, and 11. A comparison of the L50 values (means life) of these greases with the L50 values of the examples 1,3 and 4 will confirm what has already been stated, that a far better performance is obtained by the use of branched-chain dicarboxylic acids in greases than is possible with prior art greases which use the straight-chain dicarboxylic acids.

EXAMPLES 12 to 14

| | 12 | 13 | 14 (comp.) |
|---|---|---|---|
| 12-hydrostearic acid methyl ester | 13.0 | 13.0 | 13.0 |
| 3-tert-butyl adipic acid | 5.0 | 5.0 | 5.0 |
| disodium tetraborate (borax) ($Na_2B_4O_7.10\ H_2O$) | 0.3 | — | — |
| sodium(meta)borate ($NaBO_2.H4\ H_2O$) | — | 0.2 | — |
| lithium hydroxide | | | |
| monohydrate | 3.9 | 3.9 | 3.9 |
| additives | 3.75 | 3.75 | 3.75 |
| paraffinic-base stock, solvate, 125 $mm^2$/a at 40° C. | 74.05 | 74.15 | 74.35 |
| dropping point, °C. | 300 | 300 | 289 |
| consistency range at 200° C. | 1 | 1 | liquid |
| rest penetration, mm/10 | 272 | 267 | 324 |
| worked penetration, mm/10 | 279 | 275 | 345 |
| FE 9 test, mean life | | | |
| L50 at 150° C./h | 230 | 201 | — |
| L50 at 200° C./h | 22 | 19 | — |

The examples 12 and 13 show that complexation is possible not only with the lithium salts of boric acid but also with the sodium salts of boric acid, which is recognizable during preparation by an increase in consistency at elecated temperatures. If no borate is used (example 14), a grease having a relatively high dropping point will be obtained but complexation will not occur. The consistency of the grease is correspondingly low and is unsuitable for use in roller bearings at elevated temperatures.

We claim:

1. A lubricating grease for high operating temperatures comprising a base oil stock, and 1 to 35 percent by weight of a consistency-imparting thickening system consisting of:

(a) a lithium soap of a hydroxy fatty acid having 12 to 24 carbon atoms;

(b) an alkali salt of boric acid; and (c) a dilithium salt of a branched alkyl chain dicarboxylic acid having a total of 5 to 14 carbon atoms of which 4 to 10 carbon atoms are present in the chain.

2. The lubricating grease of claim 1, wherein the ratio of the weight of hydroxy fatty acid to dicarboxylic acid is 1 to 5:1.

3. The lubricating grease of claim 1, wherein said grease contains an alkali salt of boric acid which is formed from boric acid or boric-acid esters by in-situ reaction with an alkali hydroxide during the process of manufacture or is directly added as an alkali salt during the process of manufacture.

4. The lubricating grease of claim 1, wherein the alkali salt of boric acid has a weight ratio to the hydroxy fatty acid and to the dicarboxylic acid of 0.03 to 1:10.

5. The lubricating grease of claim 1, wherein the hydroxy fatty acid is 12-hydroxystearic acid.

6. The lubricating grease of claim 1, wherein said adipic acid is 3-tert-butyl branched alkyl chain dicarboxylic acid.

7. The lubricating grease of claim 1, wherein said alkali salt of boric acid is dilithium tetraborate.

8. The lubricating grease of claim 1, wherein said grease further consists of highly refined mineral oils and synthetic base oils.

9. The lubricating grease of claim 1, wherein the lithium soap of a hydroxy fatty acid is derived from an ester of the hydroxy fatty acid with alcohol having 1 to 4 carbon atoms or glycerol.

* * * * *